US005847674A

United States Patent [19]

Paroff et al.

[11] Patent Number: 5,847,674

[45] Date of Patent: Dec. 8, 1998

[54] APPARATUS AND METHODS FOR MAINTAINING OPTIMUM PRINT QUALITY IN AN INK JET PRINTER AFTER PERIODS OF INACTIVITY

[75] Inventors: Paul J. Paroff, E. Amherst; Susan Garrity, Cheektowaga; Roger J. Rowland, Niagara Falls; Michael A. Graziano, Grand Island; Anthony V. Moscato, North Tonawanda, all of N.Y.

[73] Assignee: Moore Business Forms, Inc., Grand Island, N.Y.

[21] Appl. No.: 641,743

[22] Filed: May 2, 1996

[51] Int. Cl.[6] ..... B41J 2/165

[52] U.S. Cl. ..... 347/33; 347/23; 347/31; 347/34

[58] Field of Search ..... 342/34, 44, 22, 342/33, 23, 14, 19, 35

[56] References Cited

U.S. PATENT DOCUMENTS

| | | | |
|---|---|---|---|
| 4,791,435 | 12/1988 | Smith et al. | 347/17 |
| 4,849,768 | 7/1989 | Graham . | |
| 4,970,527 | 11/1990 | Gatten . | |
| 5,107,276 | 4/1992 | Kneezel et al. | 347/60 |
| 5,109,234 | 4/1992 | Otis, Jr. et al. . | |
| 5,140,429 | 8/1992 | Ebinuma et al. | 347/23 |
| 5,168,284 | 12/1992 | Yeung . | |
| 5,185,615 | 2/1993 | Koitabashi et al. . | |
| 5,459,505 | 10/1995 | Ballegaard et al. | 342/260 |
| 5,557,306 | 9/1996 | Fukushima et al. | 347/33 |
| 5,557,307 | 9/1996 | Paroff | 347/34 |

FOREIGN PATENT DOCUMENTS

| | | | |
|---|---|---|---|
| 3508561 | 12/1985 | Germany . | |
| 63-182153 | 7/1988 | Japan | 347/75 |
| 5-84929 | 4/1993 | Japan . | |

*Primary Examiner*—N. Le
*Assistant Examiner*—Thien Tran
*Attorney, Agent, or Firm*—Nixon & Vanderhye, P.C.

[57] ABSTRACT

Substantially optimum print quality is maintained for an ink jet printer which includes a nozzle plate having a number of orifice openings from which ink droplets for printing are sprayed. It is electronically determined when a particular orifice opening has been inactive for a predetermined period of time, and then an exercise print command is supplied to the orifice causing an ink droplet to dribble out of the orifice, rather than being sprayed out of the orifice, to keep the orifice clear for printing when a print command is supplied to it. The dribbling drops have a smaller size than the sprayed drops, and may be formed by supplying heater elements associated with the openings with pulses of shorter duration than normal. Dribbling ink droplets are automatically removed from the printer cartridge by one or more strands (e.g. continuous filament rayon thread) moving past the nozzle at a speed of between about 1–3 feet per hour while being positively guided.

20 Claims, 10 Drawing Sheets

APPARATUS AND METHODS FOR MAINTAINING OPTIMUM PRINT QUALITY IN AN INK JET PRINTER AFTER PERIODS OF INACTIVITY

BACKGROUND AND SUMMARY OF THE INVENTION

Ink jet printers, particularly for documents, are versatile, effective and low cost printers that have gained widespread acceptance in numerous industries. Ink jet printers typically have a printer head carriage including a nozzle plate having nozzle orifices through which the ink is propelled in a particular manner toward the substrate with which it operates, the carriage including a cartridge and a mounting bracket movable along a shaft during operation. In the normal ink jet drop ejection (spraying) process, stray droplets or ink mist will typically accumulate above and below the line of orifices along the nozzle plate. The ink that accumulates can have negative effects on print quality. For example, the deposited mist may attract paper fibers and/or dust, and block one or more pixels, and/or the mist may build up to the point where it drips down onto the orifice openings, either blocking them or otherwise interfering with their operation.

Also, there is a problem with print clarity when various nozzles in the ink jet printer are used that have been inactive for a significant period of time. The ink may not spray accurately from the previously inactive nozzles, as they have become partially clogged as by a film forming over the inactive orifices. This problem can be solved according to the present invention by controlling the printer so as to cause dribbling of the ink from orifices that have been inactive for a sufficient period of time for there to be a danger of partial clogging, the dribbling ink keeping the orifices free so that when a print command is issued to a particular orifice it prints clearly. The ink that dribbles from the orifice opening must also be removed so that it does not interfere with ink issuing from other orifice openings.

According to one aspect of the present invention a method of maintaining substantially optimum print quality, even after periods of inactivity, for an ink jet printer including a nozzle plate having a plurality of orifice openings from which ink droplets for printing are sprayed, is provided. The method comprises the following steps: (a) Determining when a particular orifice opening has been inactive for a predetermined period of time. (b) Supplying an exercise print command to the particular orifice determined to have been inactive for a predetermined period of time by the practice of step (a). And (c) controlling the particular orifice supplied with an exercise print command so that an ink droplet issuing therefrom dribbles out of the orifice rather than being sprayed out of the orifice, so that the particular orifice is maintained ready for printing with substantially optimum print quality.

Typically the ink droplets sprayed for printing have a first size, and step (c) is practiced by controlling the particular orifice so that the ink droplet issuing therefrom has a second size smaller than the first size. Also, the ink jet printer typically has a plurality of heater elements associated with the openings, the heater elements supplied with pulses of a first duration to form the ink droplets of the first size. Step (c) is then further practiced by supplying a pulse to a heater element of a second duration, less than the first duration.

The invention also typically comprises the further step (d) of automatically wiping dribbling ink droplets from the nozzle plate and carrying them away from the nozzle plate so that they do not interfere with the print quality. Step (d) is typically practiced by moving at least one strand (the strand capable of attracting and carrying away ink) past the nozzle plate to attract and carry away dribbling ink droplets and ink mist. Step (d) is typically practiced by moving at least one strand at a speed of between 1–3 feet per hour. There is also typically the further step (d) of positively guiding the at least one strand as it moves past the nozzle plate so that it moves in a precise path. Steps (d) and (e) may be practiced by continuously moving and guiding a plurality of continuous filament rayon threads having a substantially circular cross section.

According to another aspect of the present invention an ink jet printer is provided comprising the following components: An ink jet printer head carriage including a nozzle plate having nozzle orifices. A shaft on which the carriage moves. Timing means for determining if at least selected ones of the nozzle orifices has been inactive for a predetermined period of time. And control means for controlling operation of each of the nozzle plate nozzle orifices so that each orifice is either operated in a first mode in which an ink droplet is sprayed therefrom to print a substrate, or in a second mode in which an ink droplet dribbles therefrom and does not print a substrate, or is maintained inactive; and for operating a nozzle orifice in the second mode if the nozzle orifice has been inactive for more than a predetermined period of time as determined by the timing means.

The timing means may comprise means for monitoring the activity of groups of pixels, and may comprise digital electronic hardware, software, or other conventional timing systems.

The control means preferably comprises electronic control means (e.g. digital electronic hardware), although software, microprocessors, and/or other conventional means may be utilized. Heater elements are typically provided for heating the nozzle orifices, and the electronic control means may control the period of time that the heater elements are activated to thereby control whether a given nozzle orifice is in the first or second mode. For example, the electronic control means may comprise means for cyclically controlling the heater elements for a first period of time to produce relatively large ink droplets when operating in the first mode, and for cyclically controlling the heater elements for a second period of time, shorter than the first period, to produce relatively small ink droplets when operating in the second mode. The electronic control means may comprise a digital electronic exercise data controller, a digital electronic pixel heating and time generator, and a pixel generator, all connected to the monitoring means.

The ink jet printer may further comprise the following elements: a first bracket mounted to the shaft on a first side of the carriage; at least one source of a strand capable of attracting and carrying away ink mist deposited on or adjacent the nozzle plate, the strand source mounted on the first bracket; and a rotary motor driven strand takeup mounted on a second side of the carriage, opposite the first side, for taking up at least one strand passing from the source past the nozzle plate and attracting ink deposited on or adjacent the nozzle plate and carrying the attracted ink away from the nozzle plate. Guide means may be provided for guiding movement of at least one strand from the source past the nozzle plate, and the source of strand may comprise a spool of textile material thread (e.g. continuous filament rayon thread) capable of absorbing ink.

It is the primary object of the present invention to provide a simple, reliable, effective, and cost effective method and apparatus for providing substantially optimum print quality for an ink jet printer, including by attracting and carrying away ink mist and dribbled droplets that might tend to accumulate on or adjacent the nozzle plate of an ink jet printer so as to prevent such mist and droplets from interfering with print quality or printer operation. This and other aspects of the invention will become clear from an inspection of the detailed description and from the appended claims.

DETAILED DESCRIPTION OF THE DRAWINGS

Figure 1:
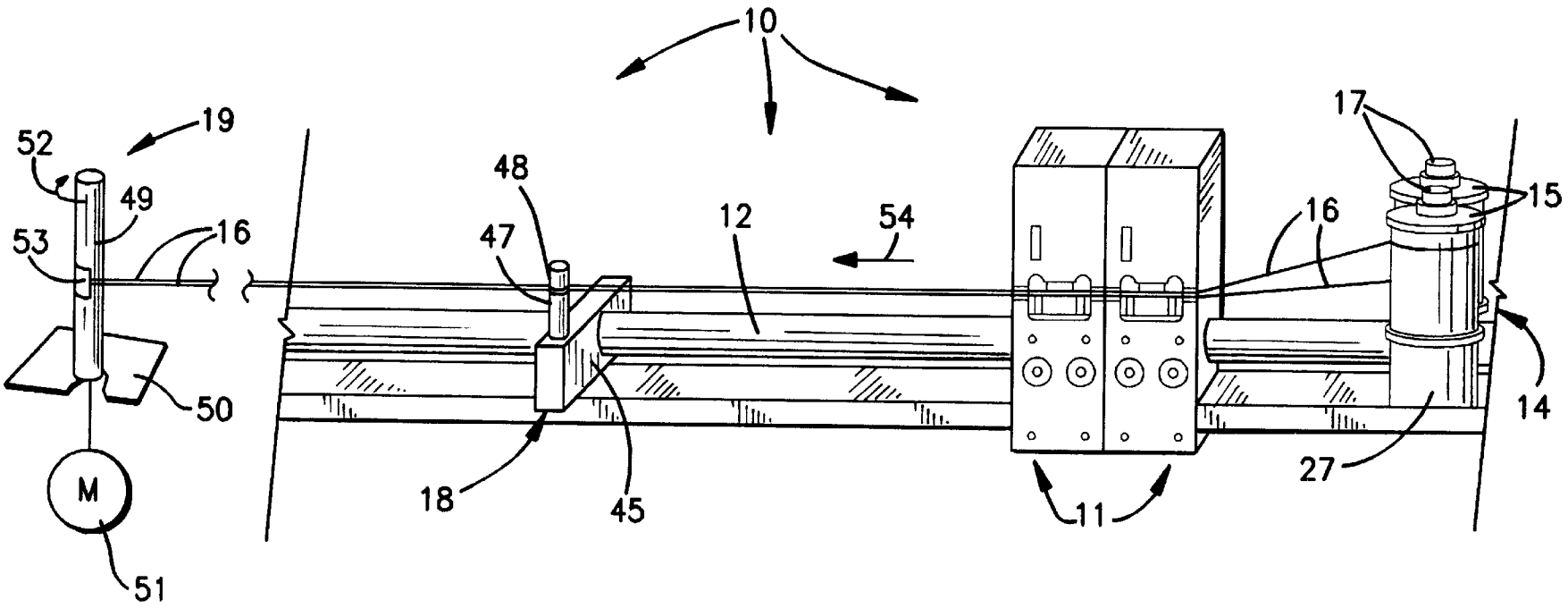
FIG. 1 is a schematic perspective view of an exemplary apparatus for clearing ink mist and dribbled droplets from an ink jet printer for use according to the present invention.

Exemplary apparatus for cleaning deposited ink mist or dribbled ink droplets from a nozzle plate of an ink jet printer is illustrated generally at reference 10 in FIG. 1, and is described in copending application Serial No. 08/277,075, filed Jul. 19, 1994 (the disclosure of which is incorporated by reference herein). An ink jet printer head carriage is illustrated generally by reference numeral 11, and it is mounted on a shaft 12, along which it moves, as is conventional. To facilitate practice of the present invention a supply 14—in the illustrated embodiment in the form of two spools 15—of a strand material 16 is positioned so that the strand material 16 unwinds from the spools 15 by rotation about axes defined by the elements 17, the axes being substantially perpendicular to the shaft 12. Guiding means—such as the guidepost structure 18—are provided for guiding the at least one strand 16 so that it attracts and carries away deposited ink. Moving means—shown generally by reference numeral 19 in FIG. 1—are provided for moving the at least one strand 16 from the supply 14, guided by the guiding means 18, away from the ink jet printer head 11 so that ink attracted by the strands 16 is carried away.

The ink jet printer head carriage 11 is conventional except for guiding elements to be described and typically includes a cartridge mounting bracket 20 and the ink cartridge 21 itself. The nozzle plate with orifice openings is illustrated schematically at 23 and 24 in FIG. 2, and is of conventional construction. The only thing different about the entire carriage 11 illustrated in FIG. 2 and a conventional carriage that moves along the conventional shaft 12, is the provision of guiding means—illustrated generally and schematically by reference numeral 25 in FIG. 2—for guiding the strand or strands 16 so that they move precisely with respect to the nozzle plate 23, 24. The guiding means 25 may comprise a wide variety of surface manifestations, but preferably is very simple in construction. For example, the guiding means 25 may—as actually schematically illustrated in FIG. 2—comprise only grooves in the bracket 20. Alternatively, or in addition, projections may be provided instead of the grooves, or the guiding means 25 may be more complex, e.g. movable (that is openable) or stationary eyelets, loops, or clamps which can cooperate in performing the guiding action.

Figure 2:
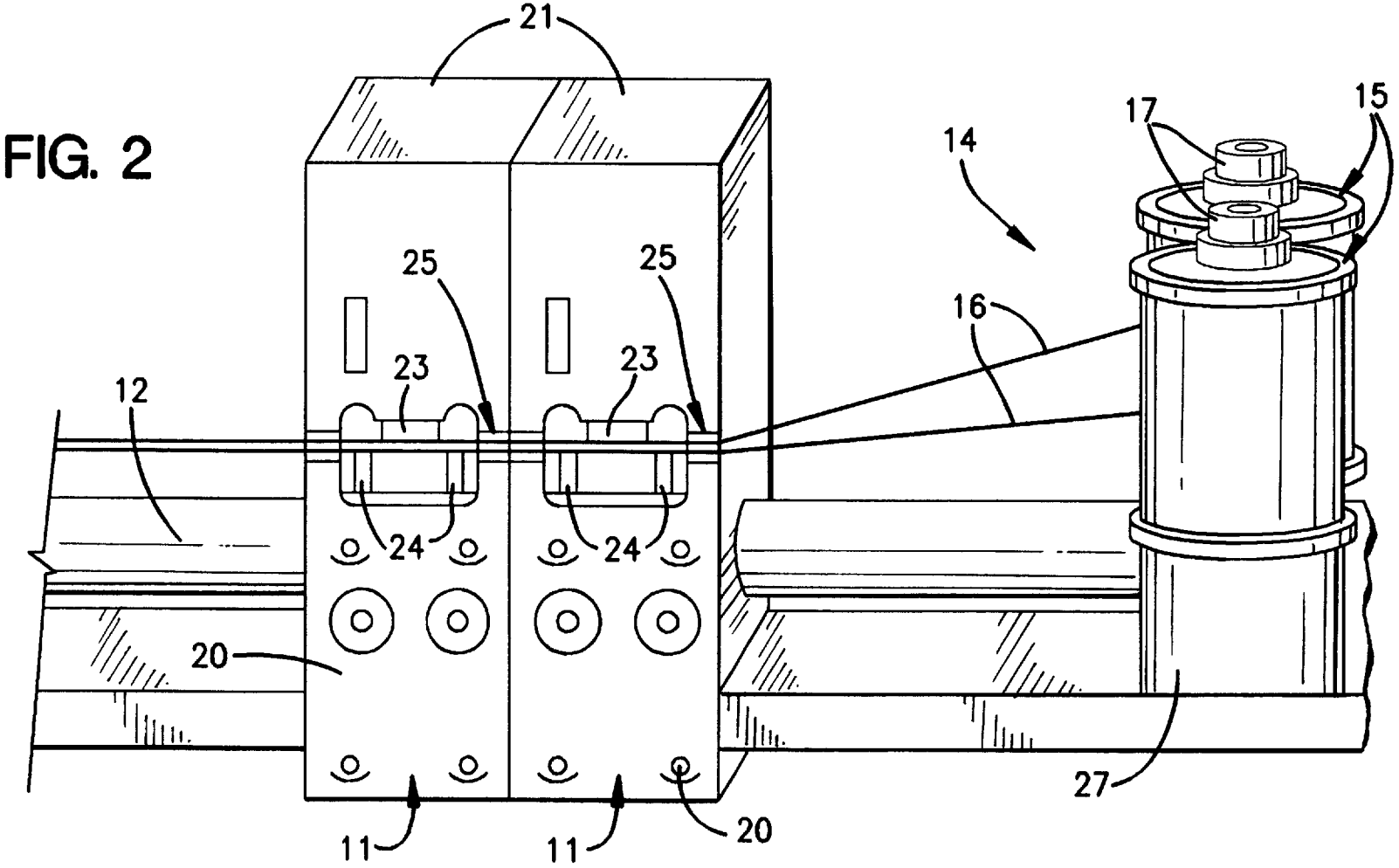
FIG. 2 is a perspective enlarged view showing the printer carriage and strand spool of the apparatus of FIG. 1.

It should be understood that what is illustrated in FIGS. 1 and 2 is only one level of a conventional ink jet printer. Typically there are six levels per array in some commercial ink jet printers with which the ink jet printer is utilizable, therefore a fully loaded array would have a dozen spools 15 if two spools per level are provided as illustrated in the embodiment illustrated in FIGS. 1 through 3.

The strand of material 16 may comprise any material which is capable of attracting and carrying away deposited ink mist or dribbled droplets when moved into contact with or adjacent the mist or droplets. While a strand 16 based upon electrostatic, magnetic or other attractive properties may be utilized, preferably the attractive property of the strand 16 is absorbency. Conventional textile material thread which can absorb ink is the preferred material for the strand 16 since it is inexpensive, readily available, and fully functional. The thread of the strand 16 may have any desired cross sectional configuration, such as a substantially circular cross section (most readily available) or it may have a substantially oblong or polygonal cross sectional configuration (much like "dental tape"). If circular in cross-section the diameter is typically about 0.0008 inches. It is preferred that the strand 16 be constructed in such a way that the material forming the strand does not have the tendency to slough off, thereby potentially causing a problem itself with print quality. Therefore, in the most preferred embodiment the strand 16 comprises a continuous filament thread, such as a rayon continuous filament thread of substantially circular cross section. This type of thread has appropriate absorbency properties and great integrity.

Figure 3:
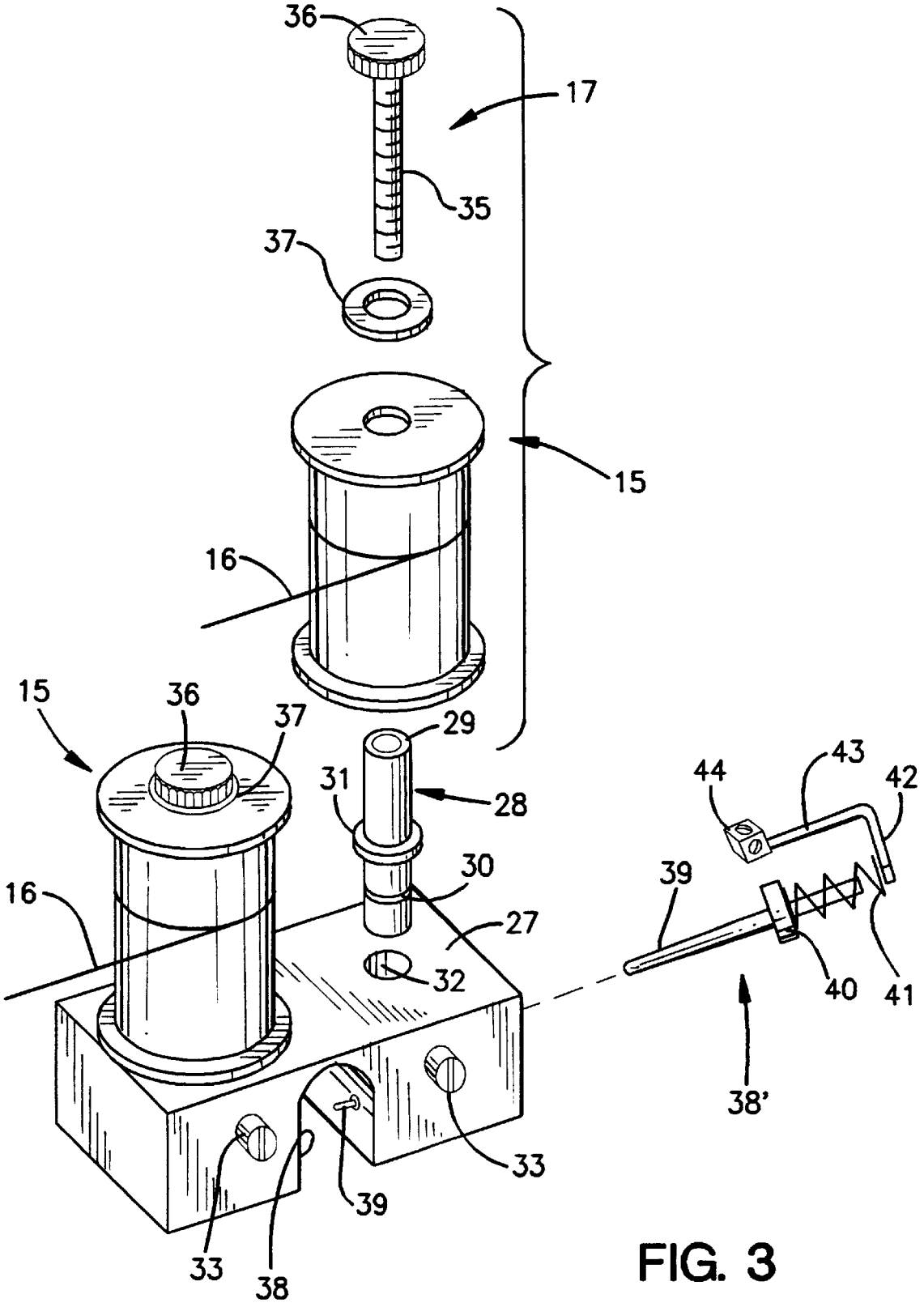
FIG. 3 is a top perspective exploded detailed view of the strand spool structure of the apparatus of FIGS. 1 and 2.

FIG. 2, and particularly FIG. 3, show the supply 14 in great detail. The spools 15 are mounted on a bracket 27 which is disposed on the shaft 12 on one side of (the right side as seen in FIGS. 1 and 2) the printer head carriage 11. The spools 15 are mounted for rotation about an axis substantially perpendicular to the shaft 12 by a bottom bearing tube 28 having an opening 29 in the top thereof, and a bottom portion 30 on the opposite side of a collar 31, the bottom portion 30 dimensioned to fit into a bore 32 formed in the top of the bracket 27 and extending along the axis of rotation. The tube 28 may be held in place with respect to the bracket 27 by the tightening of the screw 33 which extends in a threaded bore perpendicular to the bore 32. The screw 33 can be brought into frictional, holding, engagement with the portion 30 of the tube 28.

The axis defining element 17 preferably—as illustrated in FIG. 3—comprises a bolt having a threaded shank 35 and a head 36, with a washer 37 received between the head 36 and the top of the spool 15. The shank 35 threads into the opening 29 of the tube 28, the opening 29 being provided with internal threads, and the bolt 17 is tightened sufficiently so as to provide a frictional force that does not allow unrestrained rotation of the spool 15, but does allow its rotation so that the strand 16 may be taken off during normal operation.

The bracket 27 includes a central cutout 38 that is shaped and dimensioned to fit snugly over the shaft 12. In a preferred embodiment the bracket 27 is maintained in place by one or more spring pressed plungers 38', seen schematically in FIG. 3. While the exact construction of the spring pressed plunger 38' is not important, it may comprise a conventional metal plunger rod 39 having a collar 40 against which a spring—such as coil spring 41—is provided. The coil spring biases the plunger rod 39 inwardly toward the shaft 12 in the cutout 38 by pressing between the support 42 and the disk 40. The support 42 may be connected by the arm 43 and bracket 44 through the side face (not shown) of the bracket 27, the bracket attachment 44 being connected to the bracket 27 by screw threaded fasteners, welding, or any other suitable conventional fastening means. The spring 41 pressing on the plunger rod 39 to bias it inwardly to the position seen in the cutout 38 in FIG. 3 provides sufficient frictional force to hold the bracket 27 in a position to which it has been moved, yet allowing it to be easily repositioned along the shaft 12 if desired.

The guiding means—in addition to the grooves, projections, loops, etc., 25 illustrated in FIG. 2—may comprise the guide element 18, especially if the shaft 12 is very long and/or the moving means 19 is remote from the carriage 11. The guide element 18 is very simple, comprising a bracket 45 which is mounted on the shaft 12 in a manner similar to the bracket 27 (e.g. such as by using a spring pressed plunger, not shown but like plunger 38'), and a guidepost 47. The guidepost 47 has one or more grooves 48 (see FIG. 1) formed therein which guide the strand or strands 16 (e.g. one groove 48 for each strand 16).

The moving means 19 may comprise a wide variety of different structures. For example, conventional takeup reels, rollers, spools, or the like can be provided that are operated either manually, by rotary powered devices, by linear actuators, or by linear actuators providing rotary movement, air jets moving the strands to a disposal volume, nip rolls or cams for continuously or periodically engaging the strand, etc. The movement provided thereby may be intermittent, periodic, continuous, or selectively any one of these.

In the preferred simple embodiment illustrated in FIG. 1, however, the moving means 19 takes the form of a simple dowel 49 that is mounted for rotation on any suitable conventional bearing with respect to a stationary support 50 driven by an electric motor 51. The dowel 49 is typically continuously (during operation of the printer, and perhaps slightly before and/or slightly after operation of the printer), continuously rotating in the direction 52 to take up the strand or strands 16. For example, the strand or strands 16 may be attached to the dowel 49 by a piece of a conventional pressure sensitive adhesive tape 53. Once the strand 16 has been completely taken up from the spools 15 onto the dowel 49, the dowel 49 is typically thrown out, or the components recycled depending upon available technology and existing economics. Typically the motor 51 rotates very slowly (e.g. less than 1 rpm, typically about ⅕ rpm), to move the thread 16 in the direction 54 at a speed of between about 1–3 feet per hour (e.g. about 2 feet per hour). The spools 15 may, for example, hold about 600 feet of thread 16, in which case the spools 15 would last for about 300 hours of continuous operation of the printer before they need to be replaced (at the same time the dowel 49 being replaced, there being provided a simple keyed sleeve connection with the drive shaft for the motor 51).

For proper operation the spools 15 are set up to unwind counterclockwise when the rewind dowel 49 is on the right side of the array (hinge left), whereas the spools 15 should unwind clockwise when the rewind dowel 49 is in the left side (hinge right).

During initial installation, the spools 15 are mounted on the tubes 28, the bolts 17 are threaded into place, and the bracket 27 is positioned properly along the shaft 12. The strands 16 are then moved into operative association with the guiding means 25, then into contact with the grooves 48 of the guidepost 47 (if the guide element 18 is utilized), and then taped by the adhesive tape 53 onto the dowel 49. Any slack in the strands 16 is taken up by winding back the spools 15. The spools 15 are readily replaced merely by unthreading the bolt 17 by engaging the head 36 with a wrench or pliers (or even by hand), slipping a spool 15 off the sleeve 28, and putting a new spool 15 in place.

During operation the strands 16 move in a guided manner into contact with or adjacent the nozzle 23, 24 attracting (e.g. absorbing) ink mist having a tendency to accumulate on the nozzle plate 23, 24, and carrying it away. In the embodiment illustrated in the drawings both strands 16 can clean both of the nozzle plates 23, 24 associated with the cartridges 21, or one strand 16 may be guided into operative association with only one of the cartridges 21 and not the other while the other strand 16 is guided into operative association with the other cartridge 21 only, not the first one.

Figure 4:
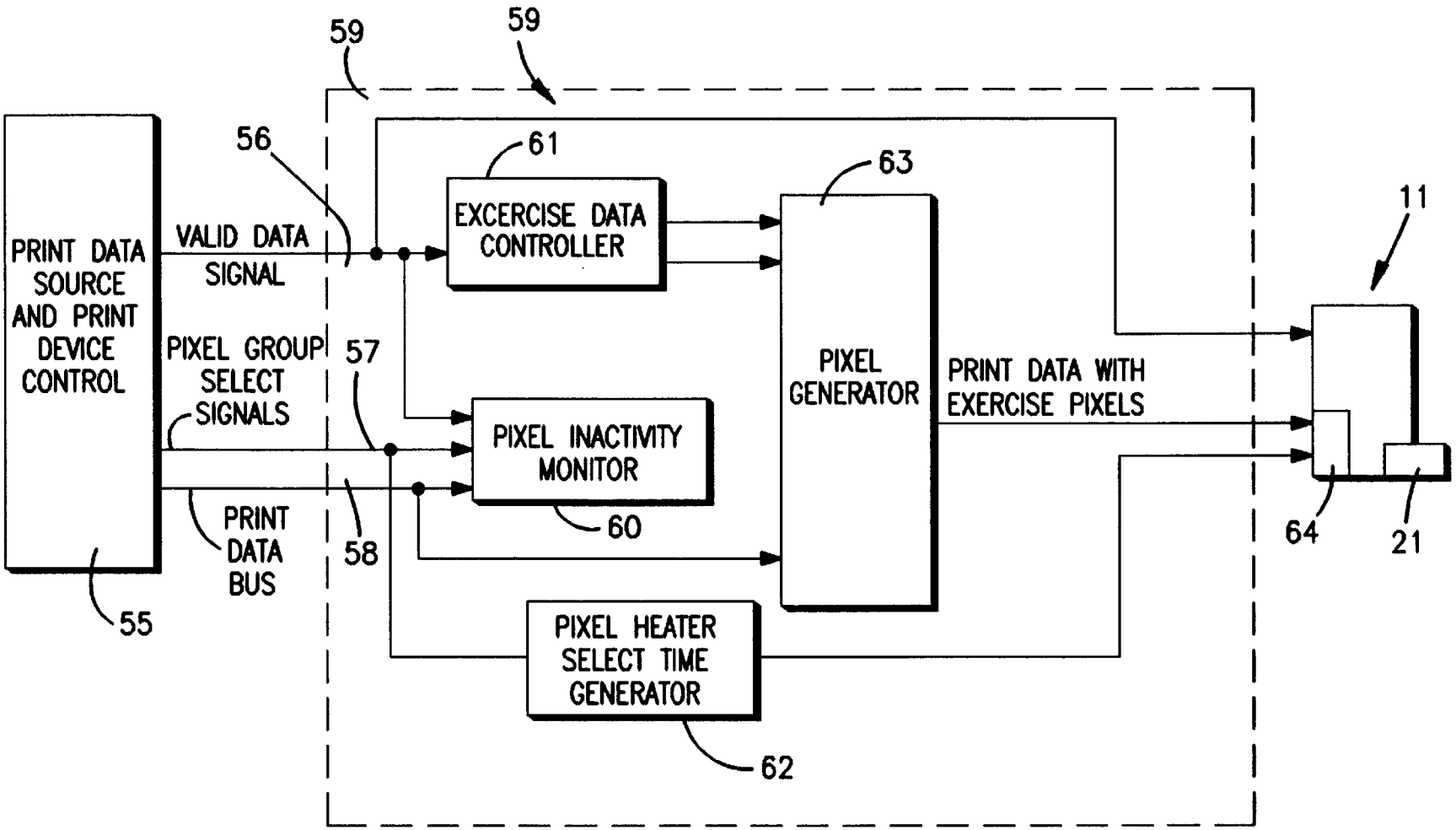
FIG. 4 is a block diagram of an ink jet system according to the present invention using cycle pixel generation to keep orifices clear during periods of inactivity.

FIG. 4 is a block diagram showing an ink jet system utilizing cycled pixel generation to keep orifices clear during periods of inactivity, according to the present invention. The structures as illustrated schematically in FIG. 4 include a conventional printer head carriage 11, and a conventional print data structure and print device control 55 which issues a valid data signal 56, a pixel group select signal 57, and print data bus 58. According to the present invention these outputs 56 through 58 are connected to the conventional ink jet printing device 11 through the system 59 according to the present invention. System 59 is for optimizing print clarity after periods of inactivity. The major components of the system 59 include the pixel inactivity monitor 60, the exercise data controller 61, the pixel heater select time generator 62, and the pixel generator 63 having the various outputs illustrated in FIG. 4, and interconnected to each other, as well as to the conventional plurality of heater elements 64 associated with the orifice opening of the ink cartridge 21, as also schematically illustrated in FIG. 4.

Figure 5:
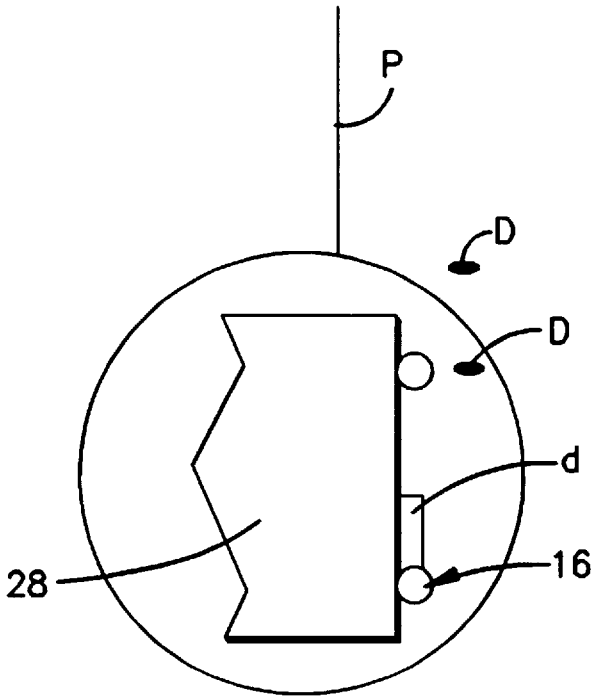
FIG. 5 is an enlarged schematic view of a cartridge of an ink jet printer utilized with the system of FIG. 4.

As schematically illustrated in FIGS. 4 and 5, print cartridge 21 in the normal (first) mode of operation sprays an ink droplet D of a first size therefrom, which impacts the substrate (piece of paper P) to print thereon. According to the preferred embodiment of the present invention, the system 59 controls the print cartridge 21 in a second mode of operation so that instead of the normal, first ink droplets D being sprayed therefrom smaller ink droplets d (see FIG. 5) dribble from the orifice openings down the face of the cartridge 21. The dribbling ink keeps the orifices clear but does not reach the paper P where it could adversely affect print quality. The dribbled ink droplets d are absorbed and are carried away by the strand or strands 16, as illustrated schematically in FIG. 5, and earlier more clearly described with respect to FIGS. 1 through 3.

In the preferred embodiment illustrated in the drawings, the function of the system 59 is to intercept data from the original data source 55 and to insert data to cyclically fire inactive nozzles before passing the data to the ink jet printing device 11. The signals that control the period of time of the nozzle heaters 64 are activated are shortened for inactive pixel groups. The shortened pulses of heat result in a smaller drop d that does not spray away from the cartridge 21 as do the drops D, but instead dribble onto the strands 16. The ink movement by the dribbling droplets d keeps the nozzle ready to fire when non-blank image data arrives.

The insertion of the additional data for keeping the nozzles clear (referred to herein as "exercise" data since the nozzles are "exercised" to keep them ready) is primary controlled by two concurrently executing processes. The first process, shown schematically by reference numeral 60 in FIG. 4, is shown in high level flow chart form in FIG. 6. The second process, shown in schematic form by reference numeral 61 in FIG. 4, is shown in high level flow chart form in FIG. 7.

Figure 6:
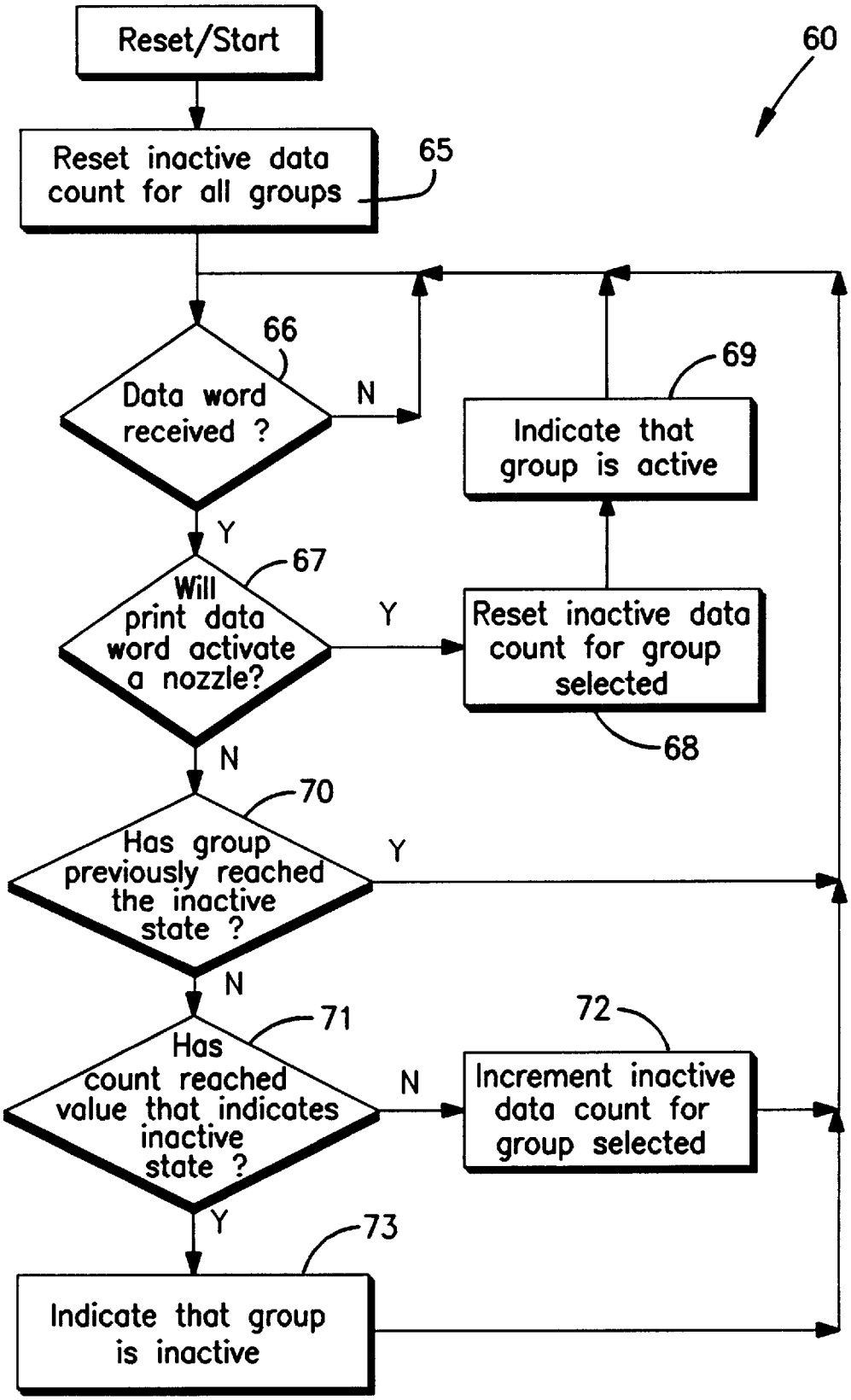
FIG. 6 is a high level control schematic illustrating the pixel inactivity monitor of FIG. 4.

The pixel inactivity monitor 60, as illustrated in FIG. 6, monitors groups of pixels for inactivity, and keeps the table available for the exercise data controller 61. For example, for the flow chart of FIG. 6, via the function block 65 the inactive data count is reset for all groups of pixels. As indicated by decision block 66, an evaluation is made as to whether a data word is received. If no data word is received then a signal returns to the reference before the decision block 66. If a data word is received and control continues to the decision block 67 which evaluates whether the print data word will activate a particular nozzle. If there is a yes decision from decision block 67, then control passes to function block 68 which resets the inactive data count for the pixel group selected, and to function block 69 which indicates that the group of pixels is active. Upon a no decision from the decision block 67, control passes to a decision block 70.

At decision block 70 a determination is made as to whether the group of pixels has previously reached inactive state. If the decision is yes, then control returns to before the first decision block 66. On a no decision, control passes to another decision block 71. In the decision block 71 evaluation is made as to whether the count has reached a value (which is predetermined depending upon operating experience for the particular printer utilized) that indicates inactive status. If the count has not reached that predetermined value, then control passes to the function block 72 which increments the inactive data count for the particular pixel group selected before there is a return to before the first decision block 66. If the decision from block 71 is yes, then as indicated by function block 73 there is an indication that that pixel group is inactive, and that data is fed to the exercise data controller 61, and to the pixel heater select time generator 62, as schematically illustrated in FIG. 4.

Figure 7:
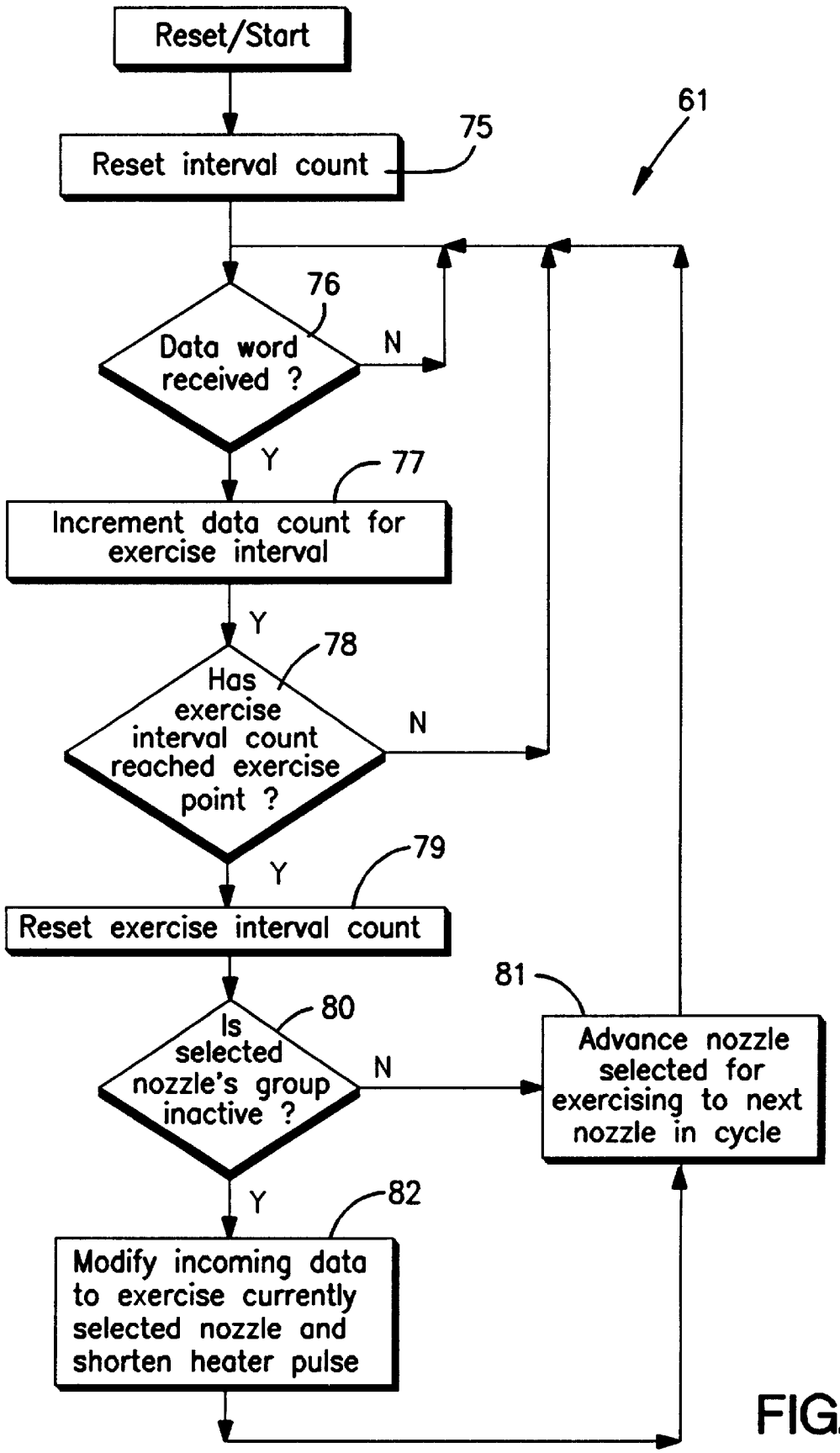
FIG. 7 is a high level control schematic illustrating the exercise data controller of FIG. 4.

The exercise data controller 61 high level flow chart of FIG. 7 uses incoming data from both the pixel inactivity monitor 60 as well as from line 56 from the print data source 55, to determine the correct interval to generate data to activate a particular nozzle orifice scheduled for exercising. The data for exercising the nozzle selected is generated when the pixel inactivity monitor process 60 indicates to the controller 61 that the pixel scheduled for exercising is in a group that is in the inactive state.

In controller 61, first there is a function block 75, where the interval count is reset. Then control passes to decision block 76 where a decision is made as to whether a data word has been received. Upon a "no" decision, control is merely returned to before the decision block 76; upon a "yes" decision control passes to the function block 77 where the data count for a particular exercising interval is incremented. From block 77 control passes to decision block 78 where the inquiry is made as to whether the exercise interval count has reached the exercise point. If the decision is no, control is returned to before the decision block 76. If yes, then at function block 79 the exercise interval count is reset. Subsequently at decision block 80 there is a determination of whether the selected nozzles group is inactive. Upon a no determination, control passes to function block 81 which advances the nozzle selected for exercising to the next nozzle in the cycle and then returns to before the first decision block 76. Upon a yes response from decision block 80, control passes to function block 82 which modifies the incoming data (56–58, but particularly 56) to exercise the currently selected nozzle while at the same time controlling the pixel heater select time generator 62 to shorten the heater 64 pulse. Shortening of the heater 64 pulse results in formation of the smaller ink droplets d, so that when the nozzle is supplied with an operation command the ink merely dribbles out of the cartridge 21 rather than being sprayed as a droplet D. As earlier described, the small droplet d that dribbles out of the nozzle orifice is carried away by one or more strands 16.

Figure 8A:
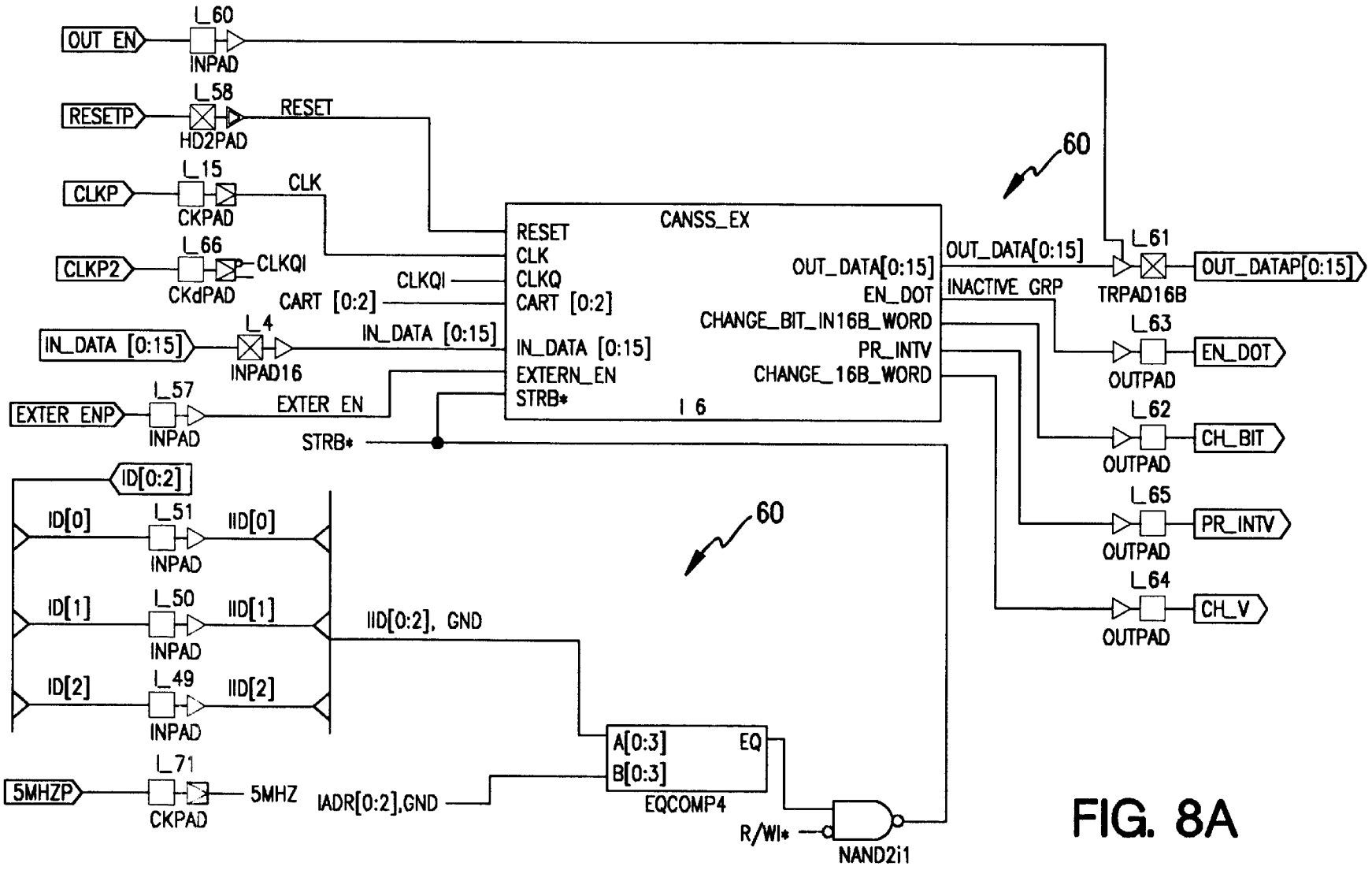
FIG. 8 is a schematic illustration of exemplary digital electronic hardware that may be utilized for the major components illustrated in FIG. 4.
Figure 8B:
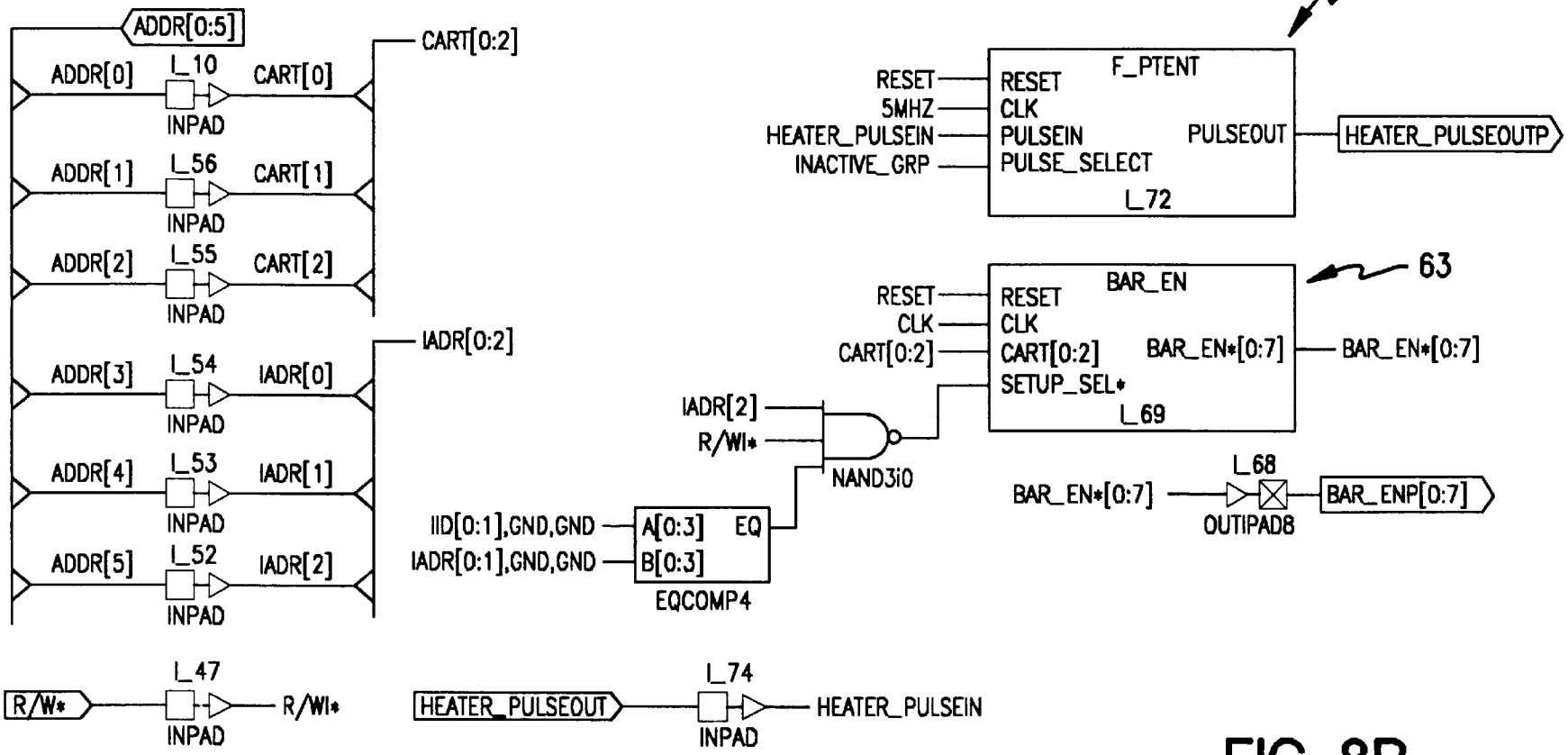
Figure 9:
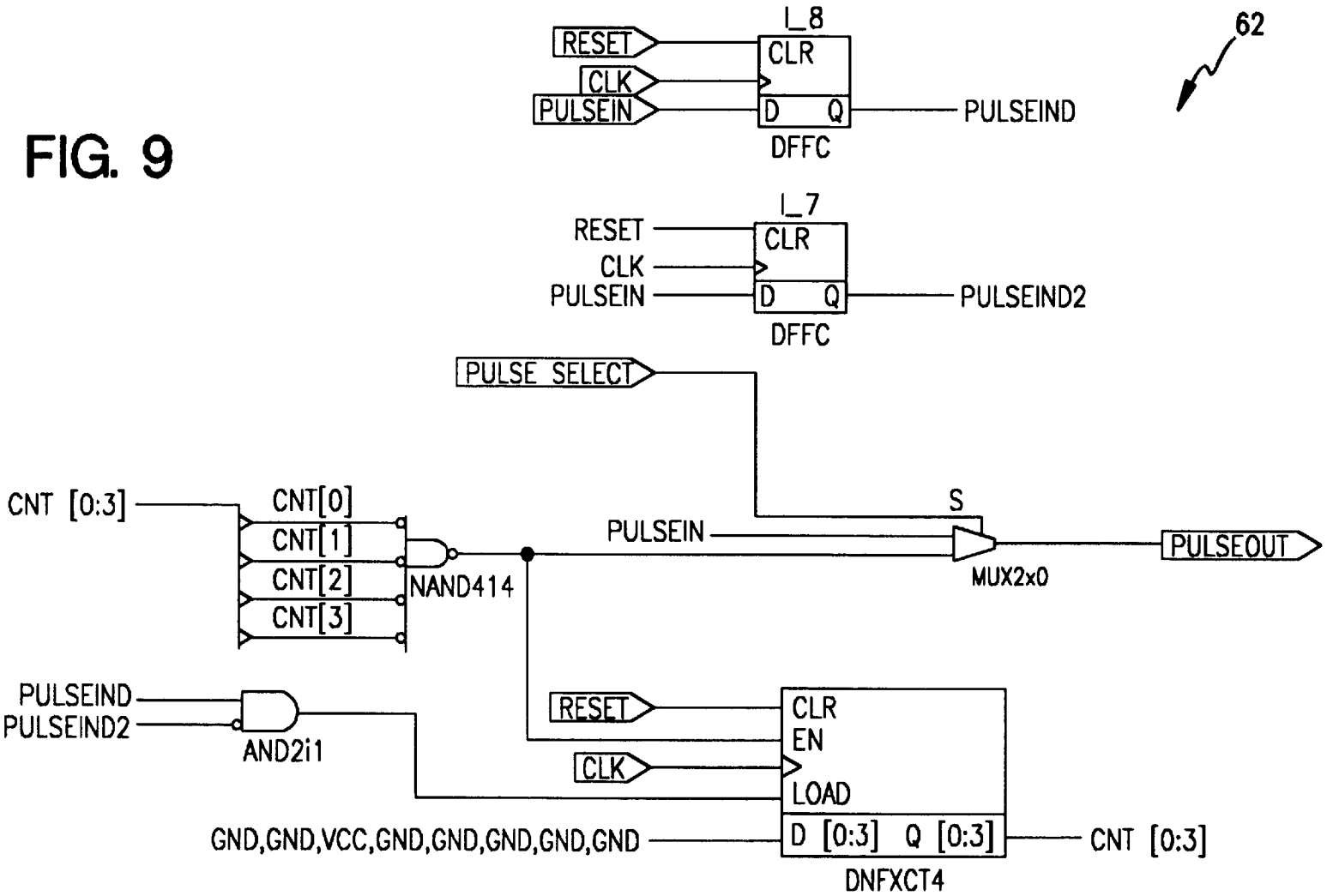
FIG. 9 is a more detailed schematic of the digital electronic hardware for the pixel heater select time generator of FIG. 8.

The high level control functions of FIGS. 4, 6 and 7 may be effected utilizing conventional digital electronic hardware connected together as illustrated, for example, in FIGS. 8 and 9. Conventional symbols are used in FIGS. 8 and 9, and a further description thereof will not be provided. FIG. 9 shows the details of the pixel heater select time generator 62 shown more schematically in FIG. 8.

It will thus be seen that according to the present invention a simple, effective, reliable, and cost effect method and apparatus have been developed for providing substantially optimum print quality for an ink jet printer, including by cleaning deposited mist, or dribbled droplets from the nozzle plate of an ink jet printer. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent systems and methods.

What is claimed is:

1. A method of maintaining substantially optimum print quality, even after periods of inactivity, for an ink jet printer including a nozzle plate having a plurality of orifices from which ink droplets for printing are sprayed, said method comprising the steps of:

(a) printing by spraying ink droplets through selected orifices onto a printable substrate;

(b) during printing according to step (a), determining when a particular orifice has been inactive for a predetermined period of time;

(c) during printing according to step (a), supplying an exercise print command to said particular orifice determined to have been inactive for a predetermined period of time by practice of step (b); and (d) during printing according to step (a), controlling said particular orifice supplied with an exercise print command so that an ink droplet issuing therefrom dribbles out of said particular orifice, rather than being sprayed out of said particular orifice, without contact with the substrate so that said particular orifice is maintained ready for printing with substantially optimum print quality.

2. A method as recited in claim 1 wherein step (a) includes spraying ink droplets having a first size; and wherein step (d) is practiced by controlling said particular orifice so that the ink droplet issuing therefrom has a second size smaller than said first size.

3. A method as recited in claim 2 wherein the ink jet printer has a plurality of heater elements associated with the orifices and including supplying the heater elements with pulses of a first duration to form the ink droplets of the first size, and wherein step (d) is further practiced by supplying a pulse to a heater element of a second duration, less than said first duration to obtain the droplet smaller in size than the first droplet size.

4. A method as recited in claim 3 including, during printing according to step (a), the further step (e) of automatically wiping dribbling ink droplets from the nozzle plate and carrying the dribbling ink droplets away from the nozzle plate so that the dribbling ink droplets do not interfere with print quality.

5. A method as recited in claim 4 wherein step (e) is practiced by moving at least one strand past the nozzle plate to attract and carry away dribbling ink droplets and ink mist.

6. A method as recited in claim 1 including, during printing according to step (a), the further step (e) of moving at least one strand past the nozzle plate to attract and carry away dribbling ink droplets and ink mist.

7. A method as recited in claim 6 including, during printing according to step (a), the further step (f) of positively guiding the at least one strand past the nozzle plate so that said at least one strand moves in a precise path.

8. A method as recited in claim 7 wherein step (e) is further practiced by moving at least one strand at a speed of between about 1–3 feet per hour.

9. A method as recited in claim 7 wherein steps (e) and (f) are further practiced by continuously moving and guiding a plurality of continuous filament rayon threads having a substantially circular cross section.

10. An ink jet printer comprising:

an ink jet printer head carriage including a nozzle plate having nozzle orifices for printing on a substrate;

a shaft on which said carriage moves;

timing means for determining if at least selected ones of said nozzle orifices has been inactive for a predetermined period of time; and control means for controlling operation of each of said nozzle plate nozzle orifices so that each orifice is either operated in a first mode in which an ink droplet is sprayed therefrom to print on the substrate, or in a second mode in which an ink droplet dribbles therefrom and does not print on a substrate, or is maintained inactive; and means for operating a nozzle orifice in said second mode to dribble ink therefrom without contact with the substrate if said nozzle orifice has been inactive for more than a predetermined period of time as determined by said timing means;

said control means controlling operation of selected nozzle orifices in said first mode to spray ink droplets therefrom to print on the substrate during operation of a nozzle orifice in said second mode, whereby dribbling occurs during printing.

11. An ink jet printer as recited in claim 10 wherein said timing means comprises means for monitoring activity of groups of pixels from a print data source.

12. An ink jet printer as recited in claim 10 wherein said control means comprises an electronic control.

13. An ink jet printer as recited in claim 12 further comprising heater elements for heating said nozzle orifices; and wherein said electronic control controls the period of time that said heater elements are activated to thereby control whether a given nozzle orifice is in said first or said second mode.

14. An ink jet printer as recited in claim 13 wherein said electronic control comprises means for cyclically controlling said heater elements for a first period of time to produce relatively large ink droplets when operating in said first mode, and for cyclically controlling said heater elements for a second period of time, shorter than said first period, to produce relatively small ink droplets when operating in said second mode.

15. An ink jet printer as recited in claim 14 further comprising a first bracket mounted to said shaft on a first side of said carriage; at least one source of a strand having a property of attracting and carrying away ink mist deposited on or adjacent said nozzle plate, said strand source mounted on said first bracket; and a rotary motor driven strand takeup mounted on a second side of said carriage, opposite said first side, for taking up at least one strand passing from said source past said nozzle plate and attracting ink deposited on or adjacent said nozzle plate and carrying the attracted ink away from said nozzle plate.

16. An ink jet printer as recited in claim 15 further comprising guide means for guiding movement of at least one strand from said source past said nozzle plate.

17. An ink jet printer as recited in claim 15 wherein said source of strand comprises a spool of textile material thread having ink absorbing properties.

18. An ink jet printer as recited in claim 17 wherein said textile material thread comprises continuous filament rayon thread.

19. An ink jet printer as recited in claim 12 wherein said timing means comprises means for monitoring activity of groups of pixels from a print data source.

20. An ink jet printer as recited in claim 19 wherein said control means comprises an electronic control, said electronic control comprising a digital electronic exercise data controller, a digital electronic pixel heating time generator, and a pixel generator, all operatively connected to said monitoring means.

* * * * *